US005580219A

United States Patent [19]

Frey et al.

[11] Patent Number: 5,580,219

[45] Date of Patent: Dec. 3, 1996

[54] CERAMIC BLADE ATTACHMENT SYSTEM

[75] Inventors: Gary A. Frey, deceased, late of Poway, Calif., by Mrs. Gary A. Frey, heir; Oscar D. Jimenez, Escondia, Calif.

[73] Assignee: Solar Turbines Incorporated, San Diego, Calif.

[21] Appl. No.: 399,952

[22] Filed: Mar. 6, 1995

[51] Int. Cl.[6] ..... F01D 5/32

[52] U.S. Cl. ..... 416/217; 416/241 B

[58] Field of Search ..... 416/215, 217, 416/218, 241 B, 248

[56] References Cited

U.S. PATENT DOCUMENTS

| | | | |
|---|---|---|---|
| 2,821,357 | 1/1958 | Schorner | 416/217 |
| 2,944,787 | 7/1960 | Gingras | 416/217 |
| 3,400,912 | 9/1968 | Carta et al. | 416/215 |
| 4,802,824 | 2/1989 | Gastebois et al. | 416/241 B |
| 5,405,245 | 4/1995 | Cornelius | 416/215 |

*Primary Examiner*—James Larson
*Attorney, Agent, or Firm*—Larry G. Cain

[57] ABSTRACT

A turbine blade having a preestablished rate of thermal expansion is attached to a turbine flange having a preestablished rate of thermal expansion being greater than the preestablished rate of thermal expansion of the turbine blade. The turbine flange includes a first upstanding flange and a second upstanding flange having a groove formed therebetween. The turbine flange further includes a recess. Each of the first and second upstanding flanges have a plurality of bores therein. A turbine blade has a first member and a second member positioned in one of the groove and the recess. Each of the first member and the second member have a plurality of bores therein. And, a pin is positioned in respective ones of the plurality of bores in the first and second upstanding members and the first and second members and attach the blade to the turbine flange. The pin has a preestablished rate of thermal expansion being substantially equal to the rate of thermal expansion of the blade.

22 Claims, 4 Drawing Sheets

CERAMIC BLADE ATTACHMENT SYSTEM

"The Government of the United States of America has rights in this invention pursuant to Contract No. DE-AC02-92CE40960 awarded by the U.S. Department of Energy."

TECHNICAL FIELD

This invention relates generally to a gas turbine engine and more particularly to a turbine wheel assembly and the joint between a ceramic blade and a turbine wheel.

BACKGROUND ART

In operation of a gas turbine engine, air at atmospheric pressure is initially compressed by a compressor and delivered to a combustion stage. In the combustion stage, heat is added to the air leaving the compressor by adding fuel to the air and burning it. The gas flow resulting from combustion of fuel in the combustion stage then expands through a turbine, delivering up some of its energy to drive the turbine and produce mechanical power.

In order to produce a driving torque, the axial turbine consists of one or more stages, each employing one row of stationary nozzle guide vanes and one row of rotating blades mounted on a turbine disc. The nozzle guide vanes are aerodynamically designed to direct incoming gas from the combustion stage onto the turbine blades and thereby transfer kinetic energy to the blades.

The gases typically entering the turbine have an entry temperature from 850 degrees to at least 1200 degrees Fahrenheit. Since the efficiency and work output of the turbine engine are related to the entry temperature of the incoming gases, there is a trend in gas turbine engine technology to increase the gas temperature. A consequence of this is that the materials of which the blades and vanes are made assume ever-increasing importance with a view to resisting the effects of elevated temperature.

Historically, nozzle guide vanes and blades have been made of metals such as high temperature steels and, more recently, nickel alloys, and it has been found necessary to provide internal cooling passages in order to prevent melting. It has been found that ceramic coatings can enhance the heat resistance of nozzle guide vanes and blades. In specialized applications, nozzle guide vanes and blades are being made entirely of ceramic, thus, imparting resistance to even higher gas entry temperatures.

However, if the nozzle guide vanes and/or blades are made of ceramic, which have a different chemical composition, physical property and coefficient of thermal expansion to that of a metal supporting structure, then undesirable stresses, a portion of which are thermal stresses, will be set up between the nozzle guide vanes and/or blades and their supports when the engine is operating. Such undesirable thermal stresses cannot adequately be contained by cooling.

Furthermore, conventional joints between blades and discs have typically used a fir tree attachment, or root design. A dovetail root design, in the recent history, has been used with a ceramic blade in which a metallic compliant layer of material is used between the highly stressed ceramic blade root and the metallic turbine disc accommodating the relative movement, sliding friction, that occurs. The sliding friction between the ceramic blade and the metallic disc creates surface induced flaws such as a scratch or scratches in the ceramic that degrades the surface. This degradation in the surface of the ceramic occurs in a tensile stress zone of the blade root, therefore, when a surface flaw is generated in the ceramic of critical size, the blade root will fail catastrophically.

The present invention is directed to overcome one or more of the problems as set forth above.

DISCLOSURE OF THE INVENTION

In one aspect of the invention, a disc assembly is comprised of a disc having a flange thereon and being made of a material having a preestablished rate of thermal expansion. The disc has a groove therein being formed between a first upstanding flange having a plurality of bores positioned therein and a second upstanding flange having a plurality of bores positioned therein. The plurality of bores in the first upstanding flange are axially aligned with the plurality of bores in the second upstanding flange. The disc further includes a recess therein. Each of the plurality of bores in the first and second upstanding flanges have a generally oval configuration. A plurality of blades are positioned in the groove and the recess. Each of the plurality of blades are made of a material having a preestablished rate of thermal expansion being less than the preestablished rate of thermal expansion of the flange. The plurality of blades have a first member confined within the groove and a second member confined within the recess. The first member has a bore therein and the second member has a bore therein. The bore in the first member and the bore in the second member are axially aligned, and each of the bores in the first and second members have a generally oval configuration. A generally oval pin is made of a material having a preestablished rate of thermal expansion being substantially equal to the preestablished rate of thermal expansion of the plurality of blades and is positioned in each of the bores in each of the first and second upstanding flanges and the first and second members.

In another aspect of the invention, a turbine blade is comprised of a base portion defining a first edge portion and a second edge portion positioned opposite the first edge portion. The base portion has a blade portion extending radially therefrom and a root portion extending radially therefrom in a direction opposite to that of the blade portion. The root portion includes a first member being indented from the first edge portion and extending radially from the base portion. The first member has a bore therein defining a preestablished geometric configuration. A second member extends radially from the base portion, is spaced from the Gas Producer Turbine first member a preestablished distance, is indented from the second edge portion and has a bore therein defining a preestablished geometric configuration. Each of the bores in the first and second members are axially aligned and are as near as possible identical one to the other. Each of the bores define a bottom portion having a preestablished cross-sectional area and a top portion having a preestablished cross-sectional area being larger than the cross-sectional area of the bottom portion.

BEST MODE FOR CARRYING OUT THE INVENTION

Figure 1:
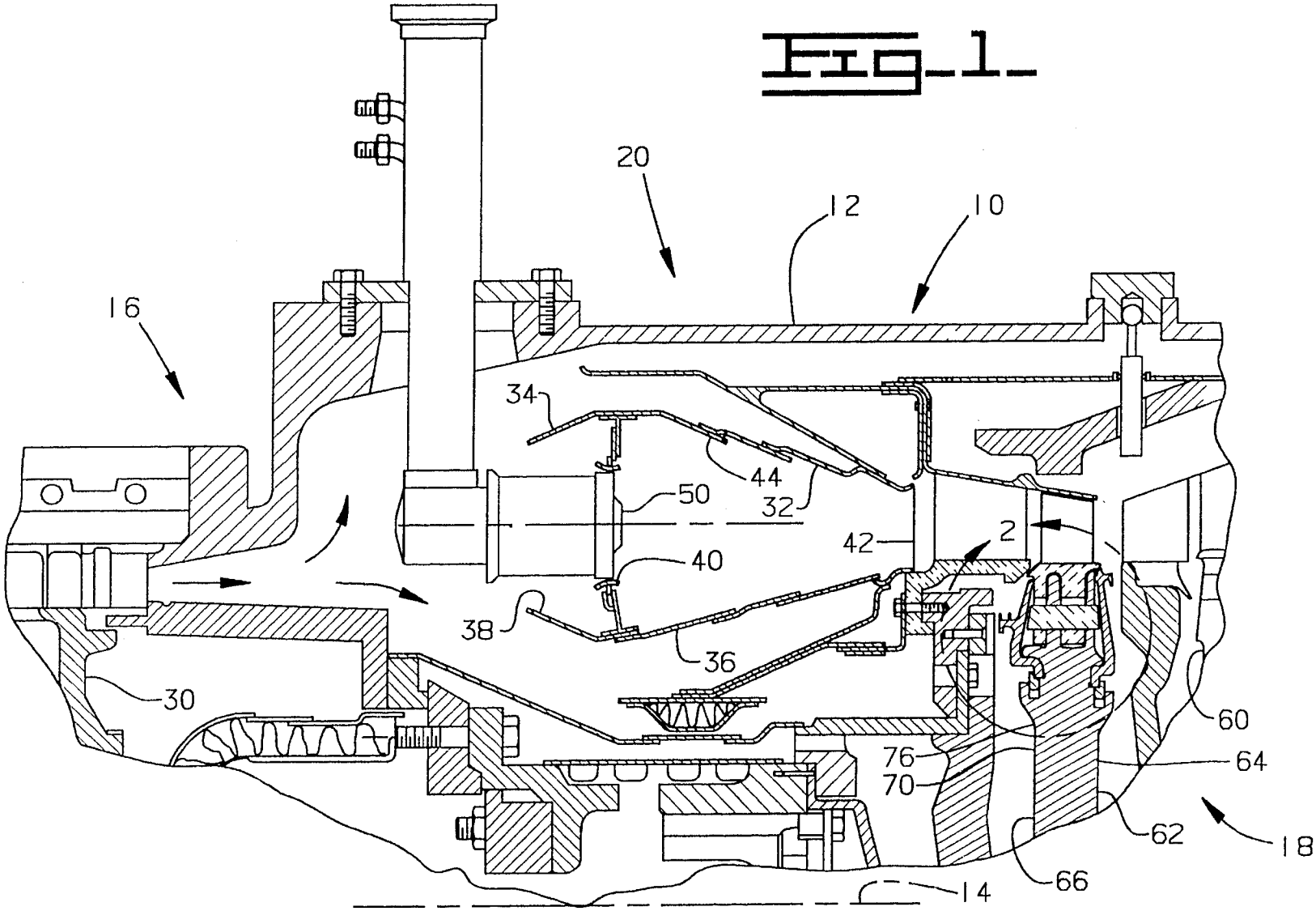
FIG. 1 is a partial side view of a gas turbine engine embodying the present invention with portions shown in section for illustration convenience.

Referring to FIG. 1, a gas turbine engine 10 is shown. The gas turbine engine 10 has an outer housing 12 having a central axis 14. Positioned in the housing 12 and centered about the axis 14 is a compressor section 16, a turbine section 18 and a combustor section 20 positioned operatively between the compressor section 16 and the turbine section 18.

When the engine 10 is in operation, the compressor section 16, which in this application includes an axial staged compressor 30 or, as an alternative, a radial compressor or any source for producing compressed air, causes a flow of compressed air which has at least a part thereof communicated to the combustor section 20. The combustor section 20, in this application, includes an annular combustor 32. The combustor 32 has a generally cylindrical outer shell 34 being coaxially positioned about the central axis 14, a generally cylindrical inner shell 36, an inlet end 38 having a plurality of generally evenly spaced openings 40 therein and an outlet end 42. In this application, the combustor 32 is constructed of a plurality of generally conical segments 44. Each of the openings 40 has an injector 50 positioned therein. As an alternative to the annular combustor 32, a plurality of can type combustors could be incorporated without changing the essence of the invention.

The turbine section 18 includes a gas producer turbine 62 connected in driving relationship to the compressor section 16. The gas producer turbine 62 includes a disc assembly 64 being rotationally positioned about the central axis 14. The disc assembly 64 includes a disc 66 being formed within an outer extremity 70. Attached to the outer extremity 70 of the disc 66 is a flange 76 having a preestablished rate of thermal expansion, best shown in FIGS. 2 and 3. The flange 76 is defined between a first or turbine side 78 and a second or combustor side 80. The flange 76 is further defined by a outer peripheral wall 82 and an inner peripheral wall 83. Extending intermediate the turbine side 78 and the combustor side 80 and extending inwardly a preestablished distance toward the inner peripheral wall 83 from the outer peripheral wall is an annular groove 84 having a generally "U" shaped configuration. The flange 76 further includes an annular recess 85 extending from the combustor side 80 toward the groove 84. The results thereof defining a first upstanding flange 86 positioned along the turbine side 78 and a second upstanding flange 88 positioned intermediate the first upstanding flange 86 and the combustor side 80. Positioned respectively from the turbine side 78 to the combustor side 80 is the first upstanding flange 86, the "U" shaped annular groove 84, the second upstanding flange 88 and the annular recess 85. The first and second upstanding flanges 86,88 define a generally fork shaped cross-section configuration. As an alternative, the annular groove 84 and the annular recess 85 could be formed by intermittent cuts along the circumference of the outer peripheral wall 82 and extend inwardly rather than being an annular groove.

The first upstanding flange 86 defines a first side surface 100 generally being an extension of the turbine side 78 of the flange 76 and a second side surface 102 being formed by a portion of the annular groove 84. The second upstanding flange 88 defines a first side surface 104 being formed by a portion of the annular groove 84 and a second side surface 106 being defined by the annular recess 85. The annular groove 84 further includes a bottom surface 108 being spaced from the central axis 14 by a preestablished radius. The turbine side 78 and the combustor side 80 of the flange 76 defines a preestablished width of the flange 76. The annular groove 84 has a preestablished width and the annular recess 85 has a preestablished depth.

The first upstanding flange 86 further includes an outer portion 110 having radiused surface 112 blendingly extending from the second side surface 102 to the outer peripheral wall 82. The second upstanding flange 88 further includes a generally radiused portion 114 positioned radially inwardly from the outer peripheral wall 82 and blendingly extends between the first side surface 104 and the second side surface 106. The first upstanding flange 86 has a plurality of bores 116 therein being spaced radially from the central axis 14 a preestablished distance. Each of the plurality of bores 116 extend axially between the first side surface 100 and the second side surface 102. Furthermore, each of the plurality of bores 116 are evenly space at a preestablished chordal distance 118 along a circumferential center line 120 formed by the preestablished distance of the radius from the central axis 14. The second upstanding flange 88 has a plurality of bores 122 therein being spaced radially from the central axis 14 a preestablished distance. Each of the plurality of bores 122 extend axially between the first side surface 104 and the second side surface 106. Furthermore, each of the plurality of bores 122 are evenly space at a preestablished chordal distance 124 along a circumferential center line 126 formed by the preestablished distance of the radius from the central axis 14. A corresponding one of the plurality of bores 116 in the first upstanding flange 86 is axially aligned with a corresponding one of the plurality of bores 122 in the second upstanding flange 88. The flange 76, in this application, is made of an alloy steel and the disc 66 and the flange 76 are a part of the disc assembly 64. As an alternative, the bores 116,122 could be put in at an angle to the central axis 14 as long as the bores 116,122 remain axially aligned, thus, the essence of the invention remains unchanged.

Furthermore, in this application, each of the circumferental center line 120 of the bores 116 and the circumferental center line 126 of the bores 122 have preferably identical preestablished distances from the central axis 14. And, each of the plurality of bores 116 in the first upstanding flange 86 and each of the plurality of bores 122 in the second upstanding flange 88 have a preestablish configuration. For example, the shape of the bores 116,122 have a generally elliptical or oval configuration including an inner radius 132 and an outer radius 134 being positioned along the radial extension from the central axis 14. Each of the inner radius 132 and the outer radius 134 have a preestablished distance which in this application is generally equal one to the other. Blendingly interconnecting each of the extremities of the inner radius 132 and the extremities of the outer radius 134 is a pair of generally radial portions 136. Respective bores 116,122 within the first upstanding flange 86 and the second upstanding flange 88 are axially aligned.

Figure 2:
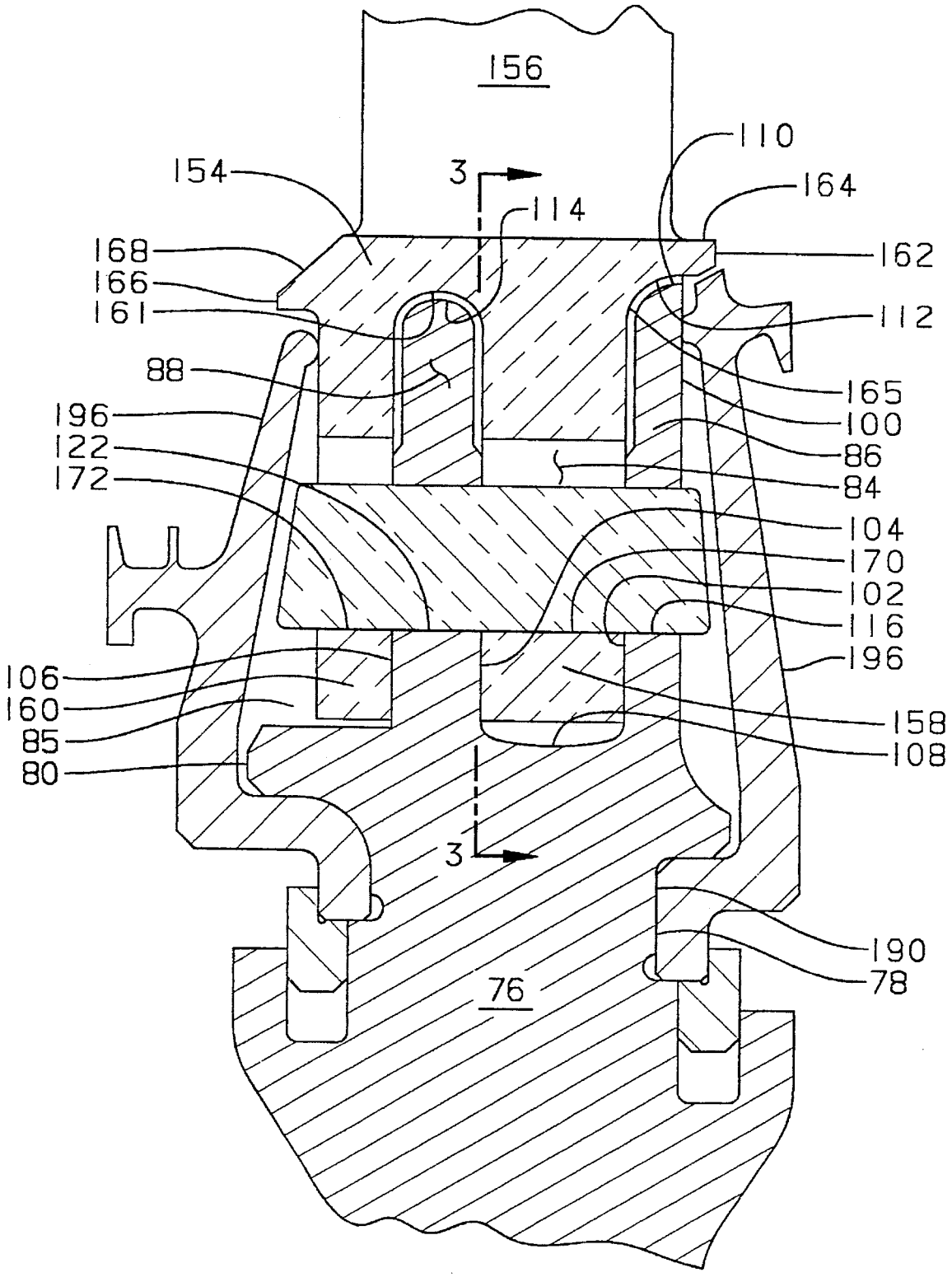
FIG. 2 is an enlarged sectional view of a joint between a ceramic blade and a disc taken along line 2—2 of FIG. 1.
Figure 3:
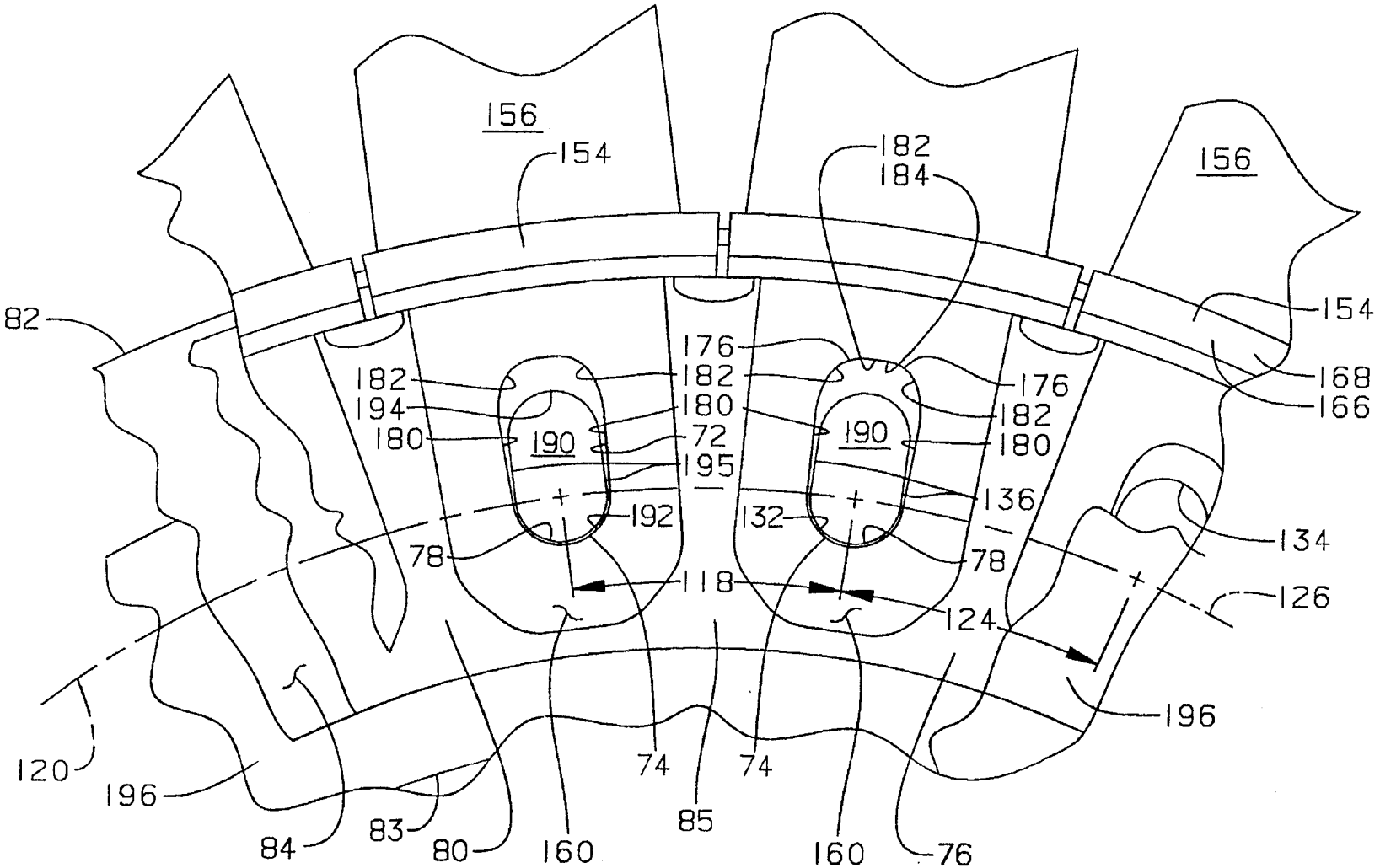
FIG. 3 is an enlarged sectional view of a joint between a ceramic blade and a disc taken along line 3—3 of FIG. 2.
Figure 4:
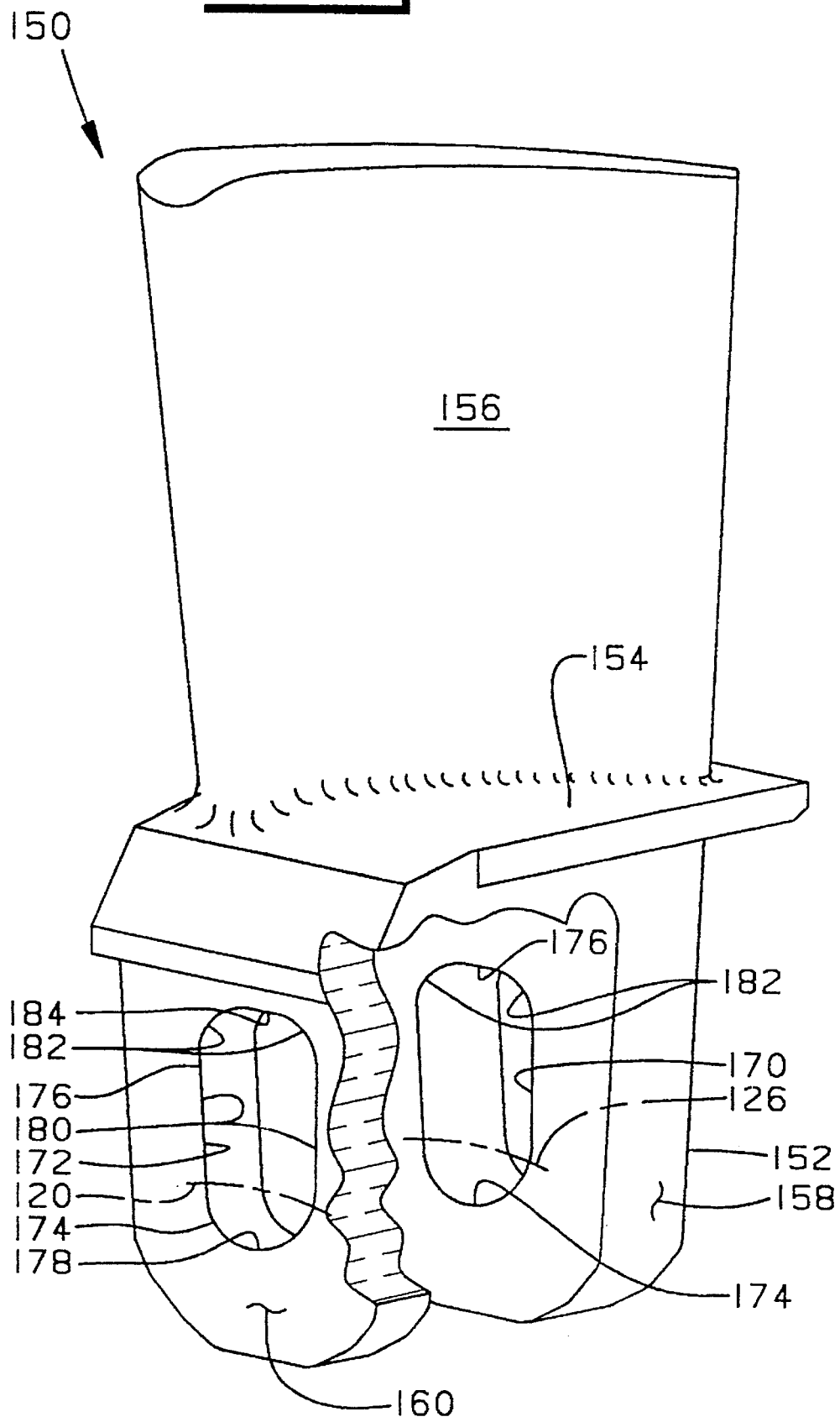
FIG. 4 is an enlarged isometric view of the ceramic blade.

As further shown in FIGS. 2, 3 and 4, a plurality of blades 150 are positioned within the flange 76. Each of the plurality of blades 150 includes a root portion 152 generally confined within the annular groove 84 and the annular recess 85. Each of the blades 150 further includes a base portion 154 extending radially outwardly from the root portion 152 and a blade portion 156 radially extending outwardly from the base portion 154. The blade 150, in this application, is made of a ceramic material, such as silicon carbide or silicon nitride, and has a preestablished rate of thermal expansion which is less than the preestablished rate of thermal expansion of the flange 76. The root portion 152 includes a first member 158 radial extending inwardly from the base portion 154 and a second member 160 radially extending inwardly from the base portion 154. The first member 158 is spaced from the second member 160 a preestablished distance which in this application is slightly greater than the preestablished width of the second upstanding flange 88. The first member 158 is indented from a first edge portion 162 of the base portion 154 a preestablished distance. The first edge portion 162 includes a lip 164 which extends from the radially outermost portion of the base portion 154. The lip 164 is positioned adjacent the turbine section 18 and overlaps the turbine side 78 of the flange 76 and the first side surface 100 of the first upstanding flange 86. The lip 164 blendingly connects with the first member 158. The second member 160 is indented from a second edge portion 166 of the base portion 154 a preestablished distance. The second edge porion 166 is positioned opposite the first edge portion 162 and has an protrusion 168 extending therefrom. The protrusion 168 axially extends generally from the radially innermost portion of the base portion 154. The protrusion 168 has a generally axial configuration, is positioned adjacent the combustor section 20 and overlaps the combustor side 80 of the flange 76. The protrusion 168 blendingly connects with the second member 160. With the plurality of blades 150 positioned within the flange 76 respective ones of the lips 164 extend axially over and radially above the outer portion 110 of the first upstanding flange 86. Each of the first members 158 has a bore 170 therein being spaced radially from the central axis 14 a preestablished distance. The bore 170 extend the entire width of the first member 158. The second member 160 has a bore 172 therein being spaced radially from the central axis 14 a preestablished distance. The bore 172 extends the entire width of the second member 160. The bore 170 in the first member is axially aligned with the bore 172 in the second member 160. As an alternative, the bores 170,172 in the first and second members 158,160 could be put in at an angle to the central axis 14 as long as the bores 116,122 in the first and second upstanding flanges 86,88 and the bores 170,172 in the first and second members 158,160 remain axially aligned, thus, the essence of the invention remains unchanged.

The bore 170 in the first member 158 and the bore 172 in the second member 160 each have a preestablished geometric configuration which is as near as possible identical. The geometric configuration is best describes as an elliptical or oval configuration. For example, a bottom portion 174, nearest to the central axis 14, of the individual bores 170,172 is separated from a top portion 176 by the circumferental center lines 120,126. The bottom portion 174 is defined by a radius 178 having a preestablished length. The radius 178 is blendingly connected with a pair of side walls 180 which extend generally radially outwardly. Each one of the pair of side walls 180 is diverging from the other and is blendingly attached to the top portion 176 by a radius portion 182. Interposed each of the radius portions 182 is circumferential length portion 184. Thus, in generalities the top portion 176 has a larger cross-sectional area than is the cross-sectional area of the bottom portion 174. In this application, the inner radius 132 of the bores 116,122 in the first and second upstanding flanges 86,88 are slightly smaller than the radius 178 in the bottom portion 174 of the bores 170,172 within the first and second members 158,160.

Removably attaching each of the plurality of blades 150 to the flange 76 is a pin 190. In this application, the pin 190 has a preestablished rate of thermal expansion equivalent to that of the blade 150; however, as an option the rate of thermal expansion of the pin 190 could be varied without changing the essence of the invention. The pin 190 has a preestablished length which is generally equal to the width of the flange 76. The pin 190 has a preestablished cross-sectional configuration defining a generally truncated oval configuration. The oval configuration is generally identical to that of the oval configuration of the bores 116,122 in the first and second upstanding flanges 86,88 of the flange 76. The oval configuration defines a first radiused portion 192 and a second radiused portion 194 positioned radially outwardly of the first radiused portion 192. Each of the first and second radiused portions 192,194 are connected by a pair of connecting walls 195 completing the formation of the truncated oval configuration of the pin 190. In the assembled position, the first member 158 of the individual blade 150 is positioned within the "U" shaped annular groove 84 and the second member 160 of the individual blade 150 is positioned within the annular recess 85. The bores 170,172 within the first and second members 158,160 and the bores 116,122 within the first and second upstanding flanges 86,88 are axially aligned and the pin 190 is slidable positioned therein removably attaching the individual blade 150 to the flange 76. This procedure is repeated until all of the blade 150 are positioned within the flange 76. After each of the plurality of blades 150 is positioned in the flange 76, a pair of sealing retainers 196 are attached to the disc 66 and/or flange 76 in any one of a conventional manner.

INDUSTRIAL APPLICABILITY

In use, the gas turbine engine 10 is started and allowed to warm up as in any suitable power application. As the demand for load or power is increased, the load on the engine 10 output is increased by increasing the fuel resulting in the temperature within the engine 10 increasing. The components used to make up the disc assembly 64, being of different materials and different rates of thermal expansion, grow at different rates and the forces resulting therefrom and acting thereon must be structurally compensated for to increase life and efficiency of the gas turbine engine 10. For example, as the disc assembly 64 rotates, centrifugal forces cause each of the plurality of blades 150 to exert an outward force on the pin 190 and on the flange 76.

As the gas turbine is started and warms to operating temperature, the blades 150 are moved outwardly due to centrifugal force. The interface between the metallic flange 76 and the ceramic pin 190 will change due to thermal growth. For Example, the overall size of the bore 116 within the first upstanding flange 86 will increase in size by a greater amount than the overall size of the pin 190 since the first upstanding flange 86 is made of a metallic material and the pin 190 is made of a ceramic material. Similarly, overall size of the bore 122 within the second upstanding flange 88 will increase in size by a greater amount than the overall size of the pin 190 since the second upstanding flange 88 is made of a metallic material and the pin 190 is made of a ceramic material. However, since the blade 150 and the pin 190 are made of the same material, ceramic, they will each expand at generally the same rate and the relative size of the bore 170 in the first member 158 and the bore 172 in the second member 160 as compared to the pin 190 will remain generally the same. The bore 170 in the first member 158 and the bore 172 in the second member 160 having the top portion 176 being larger in cross-sectional area and different in configuration functionally allows relative movement between the interface of the pin 190 and the blade 150. Thus, a generally rotational relationship exist at the interface and the stress therein is reduced, increasing component life and reducing premature failures.

As further defined, a portion of the first radiused portion 192 of the pin 190 is in frictional surface contact with the radius 178 of the bottom portion 174 of the bore 170 within the first member 158 and the radius 178 of the bottom portion 174 of the bore 172 within the second member 160. Thus, the contacting frictional surfaces, the outer radius 134 and the second radiused portion 194 of the pin 190 and the flange 76 of the disc 66 and the radius 178 and the first radiused portion 192 of the pin 190 and the root portion 152 of the blade 150, have radial surfaces contacting therebetween and the stress is distributed throughout the radial surfaces. Furthermore, the relative size of the top portion 176 of the bore 170 in the first member 158 and the outer radius 134 of the pin 190, the arcuate portion 161 between the first member 158 and the second member 160 and the radiused portion 114 of the second upstanding flange 86, the top portion 176 of the bore 172 in the second member 160 and the outer radius 134 of the pin 190 and the blending portion connecting the lip 164 with the first member 158 and the radiused surface 112 of the first upstanding flange 86 are spaced apart and allow a flow of cooling fluid to pass therethrough.

Thus, stress in the tensile stressed region of the blade 150 of the root portion 152 is reduced. The configuration of the radiused surfaces between the pin 190 and the first and second members 158,150 place more area in contacting relationship to reduce stress.

Other aspects, objects and advantages of this invention can be obtained from a study of the drawings, the disclosure and the appended claims.

We claim:

1. A disc assembly comprising:

a disc having a flange thereon and being made of a material having a preestablished rate of thermal expansion and having a groove therein, said groove being formed between a first upstanding flange having a plurality of bores positioned therein and a second upstanding flange having a plurality of bores positioned therein, said plurality of bores in the first upstanding flange being axially aligned with said plurality of bores in the second upstanding flange, each of said plurality of bores in the first and second upstanding flanges having a generally oval configuration;

a plurality of blades positioned in the groove, each of said plurality of blades being made of a material having a preestablished rate of thermal expansion being less than the preestablished rate of thermal expansion of the flange, having a first member confined within the groove, said first member having a bore therein, said bore in the first member and said bores in the first and second upstanding flanges being axially aligned, and each of said bores in the first member having a generally oval configuration; and a generally oval pin being made of a material having a preestablished rate of thermal expansion being substantially equal to the preestablished rate of thermal expansion of the plurality of blades, being positioned in each of the bores in each of the first and second upstanding flanges and the first member.

2. The disc assembly of claim 1 wherein said bores in the first upstanding flange and said bores in the second upstanding flange are defined by an inner radius and an outer radius being connected by a pair of radial portions.

3. The disc assembly of claim 2 wherein said inner radius and said outer radius are generally equal one to the other.

4. The disc assembly of claim 1 wherein said bore in the first member includes a bottom portion and a top portion being connected by a pair of side walls, said bottom portion being defined by a radius and said top portion being defined by a pair of radius portions connected to the pair of side walls and a circumferential portion interposed the pair of radius portions.

5. The disc assembly of claim 4 wherein said bottom portion has a preestablish cross-sectional area and said top portion has a preestablished cross-sectional area being larger than the cross-sectional area of the bottom portion.

6. The disc assembly of claim 4 wherein said pair of side walls diverge one from the other.

7. The disc assembly of claim 6 wherein said pair of side walls are further apart near the top portion of the bore in the first member.

8. The disc assembly of claim 1 wherein said groove is an annular groove.

9. The disc assembly of claim 1 wherein said pin is substantially a surface to surface fit within the bores in the first and second upstanding flanges.

10. A turbine blade comprising:

a base portion defining a first edge portion and a second edge portion positioned opposite the first edge portion, said base porion having a blade portion extending radially therefrom and a root portion extending radially therefrom in a direction opposite to that of the blade portion;

said root portion including a first member being indented from the first edge porion and extending radially from the base portion, said first member having a bore therein defining a preestablished geometric configuration, and a second member extending radially from the base portion, said second member being spaced from the first member a preestablished distance, being indented from the second edge portion and having a bore therein defining a preestablished geometric configuration;

each of said bores in the first and second members being axially aligned and being as near as possible identical one to the other; each of said bores defining a bottom portion having a preestablished cross-sectional area and a top portion having a preestablished cross-sectional area being larger than the cross-sectional area of the bottom portion.

11. The turbine blade of claim 10 wherein said bottom portion being defined by a radius having a preestablished length.

12. The turbine blade of claim 11 wherein said top portion being defined by a pair of radius portions connected by a circumferential length portion.

13. The turbine blade of claim 12 wherein said bottom portion and said top portion are connected by a pair of side walls blendingly interposed the radius and the pair of radius portions.

14. The turbine blade of claim 13 wherein said pair of side walls are diverging one from the other.

15. The turbine blade of claim 10 wherein said preestablished geometric configuration of the bores is generally an oval configuration.

16. The turbine blade of claim 10 wherein said first edge portion includes a lip extending therefrom.

17. The turbine blade of claim 16 wherein said second edge portion includes a protrusion extending therefrom.

18. The turbine blade of claim 10 wherein said turbine blade is made of a ceramic material.

19. A disc assembly comprising:

a disc having a flange thereon having a plurality of bores positioned therein, each of said plurality of bores in the flange having a generally oval configuration;

a plurality of blades being attached to the flange, said plurality of blades defining a member having a bore therein having a generally oval configuration; and a generally oval pin being positioned in each of the bores in the flange and the member.

20. The disc assembly of claim 19 wherein said disc being made of a material having a preestablished rate of thermal expansion.

21. The disc assembly of claim 20 wherein said plurality of blades being made of a material having a preestablished rate of thermal expansion being less than the preestablished rate of thermal expansion of the disc.

22. The disc assembly of claim 19 wherein said pin being made of a material having a preestablished rate of thermal expansion and said plurality of blades have a preestablished rate of thermal expansion and said preestablished rate of thermal expansion of said pin being substantially equal to the preestablished rate of thermal expansion of the plurality of blades.

* * * * *